United States Patent [19]

Yamashita

[11] 4,008,839

[45] Feb. 22, 1977

[54] TAPE FEEDING APPARATUS

[75] Inventor: Kyoichi Yamashita, Yokohama, Japan

[73] Assignee: Koyo Jidoki Kabushiki Kaisha, Yokohama, Japan

[22] Filed: Nov. 6, 1975

[21] Appl. No.: 629,414

[30] Foreign Application Priority Data

Nov. 7, 1974 Japan ..... 49-127542

[52] U.S. Cl. ..... 226/32; 226/33; 226/142; 226/178

[51] Int. Cl.² ..... B65H 23/18

[58] Field of Search ..... 226/32, 33, 42, 43, 226/142, 178

[56] References Cited

UNITED STATES PATENTS

| | | | |
|---|---|---|---|
| 2,821,388 | 1/1958 | Crane | 226/32 |
| 2,841,997 | 7/1958 | Maust | 226/142 UX |

FOREIGN PATENTS OR APPLICATIONS

| | | | |
|---|---|---|---|
| 877,825 | 8/1971 | Canada | 226/32 |

*Primary Examiner*—Richard A. Schacher
*Attorney, Agent, or Firm*—Woodhams, Blanchard and Flynn

[57] ABSTRACT

A tape feeding apparatus having a rotary member for feeding a tape which is drivingly connected with rotary driving means through at least two link mechanisms to be rotated at different speeds and with a phase difference so that one of the link mechanisms for a low speed rotation is set in operation just before another enters its dead point. With this structure, intermittent tape feeding can be effected at a high speed, while allowing quick stopping of the rotary member at a required position.

7 Claims, 4 Drawing Figures

TAPE FEEDING APPARATUS

FIELD OF THE INVENTION

This invention relates to a tape feeding apparatus, and more particularly to an apparatus intermittently feeding a tape according to marks printed thereon for use with a labelling machine etc.

BACKGROUND OF THE INVENTION

Labelling a bottle etc. has been conventionally conducted by picking up preliminarily cut labels one by one and putting them on the bottles etc. This method, however, has a fatal defect that there is a possibility that wrong labels or labels of different kinds may get mixed during setting of labels in a labelling machine. If the indication of a label is inconsistent with the contents of an article to which the label is affixed, the article is not marketable, and moreover it may possibly endanger a user's life in case the article is chemicals etc.

In this connection, it has been proposed, to eliminate any possibility of mixing of different kinds of labels, that a series of labels printed on a tape and wound into a roll be employed, being cut one by one just before labelling articles. In this method, it is required to repeat, at a high speed, feeding a tape by a length of one label, stopping the feeding, cutting the tape into a label, pasting the label and labelling an article such as a bottle etc. However, patterns for indication, such as marks or letters printed on the respective labels of the tape are not always of the same length because of expansion and contraction of the paper caused during printing, expansion due to a tensile force caused in feeding, or expansion and contraction according to weather of humidity. Accordingly, if the tape is cut after feeding thereof by a predetermined length in disregard of such possible expansion or contraction of the paper, only labels of the same length can be obtained but labels properly bearing patterns, such as marks or letters thereon can not always be obtained and the marks or letters may possibly get out of the position, spoiling the labels.

On the other hand, it is to be noted that since the present art level of cutting and pasting techniques can well meet a high speed labelling operation, the performance of the labelling machine is determined depending upon how quickly and accurately the labels fed at a high speed can be stopped at a required position according to the patterns printed thereon.

It is therefore an object of the present invention to provide a tape feeding apparatus which is capable of stopping the tape which is being fed at a high speed, accurately and surely at a required position in relation with marks or letters printed on the tape.

According to the present invention, there is provided a tape feeding apparatus comprising a rotary member for feeding a tape; a rotary shaft of the rotary member; at least two clutch means mounted on the rotary shaft and adapted to rotate said rotary shaft in one direction only; lever members connected to the clutch means, respectively, for effecting rotation of said clutch means; connecting rods pivotally connected to the lever members, respectively; rotary driving means; and means drivingly connecting the rotary driving means to said connecting rods and adapted to impart a reciprocating motion to the respective connecting rods according to the operation of the rotary driving means; said levers and said connecting rods being arranged in positions to rotate the respective clutch means at different speeds and with a phase difference according to the reciprocating motion of the connecting rods so that one of the connecting rods for a low speed rotation is set in operation just before another enters its dead point.

BRIEF DESCRIPTION OF THE DRAWINGS

This invention will be better understood from the following description taken in connection with the accompanying drawings in which.

DETAILED DESCRIPTION

Figure 1:
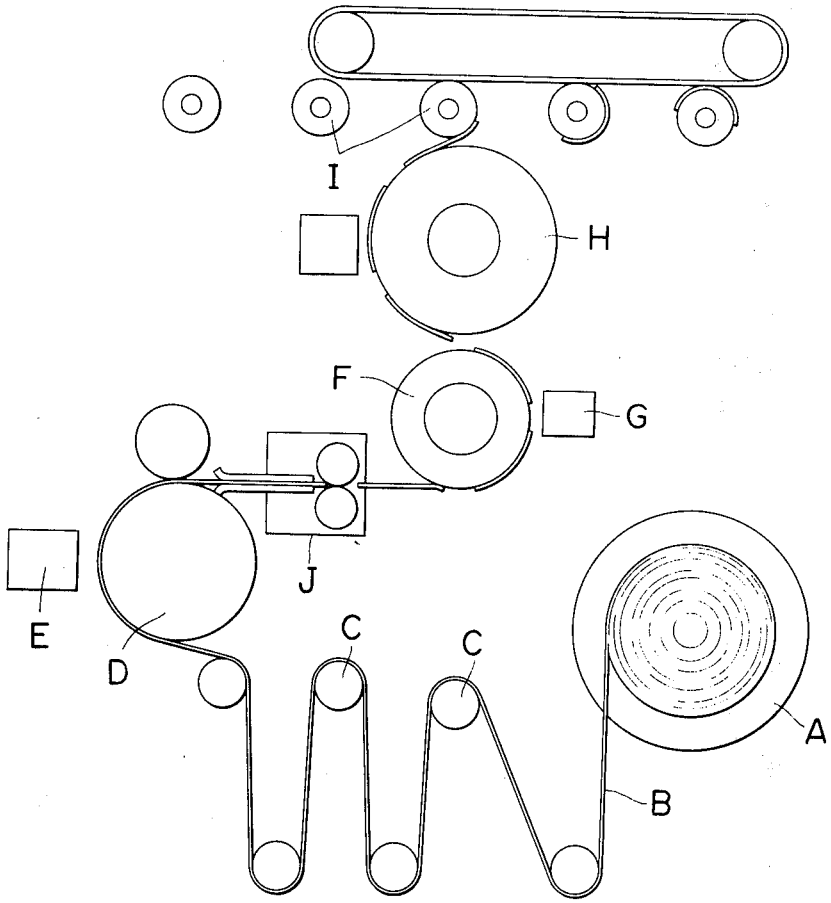
FIG. 1 is a diagrammatical view showing a tape feeding apparatus according to the present invention used with a labelling apparatus.

Referring now to the drawings, there is illustrated one embodiment of the present invention.

FIG. 1 shows explanatorily a whole arrangement for the labelling operation according to the present invention, including a cutting member for cutting a tape into a label, a printing member for printing a manufacturing date, a pasting member for pasting the rear side of the label and a labelling member for affixing the label to a bottle etc.

A tape B mounted on a reel member A is pulled by a tape feeding drum D through intermediate rollers C and fed to a cutter J. The intermediate rollers C are provided for keeping the tension of the tape B constant.

The drum D is associated with a mark detecting photo-electric tube E provided adjacent to the drum D for detecting check marks $B_1$ printed on the rear side of the tape B for defining labels and adapted to be intermittently rotated by an angle corresponding to the distance between the marks $B_1$ and stopped upon detection of the mark $B_1$ by the photo-electric tube E, so that the tape B may be cut into labels of a length $B_1$—$B_1$ by a cutter J.

A date printing drum F is provided after the cutter J to print, while attracting the label at a negative pressure, a manufacturing date on the label by a printer G. The label is then fed to a pasting drum H. The pasting drum H is also adapted to stick the label thereto at a negative pressure so that the label may be pasted on its rear side. The label thus pasted is then affixed to a bottle I.

Figure 2:
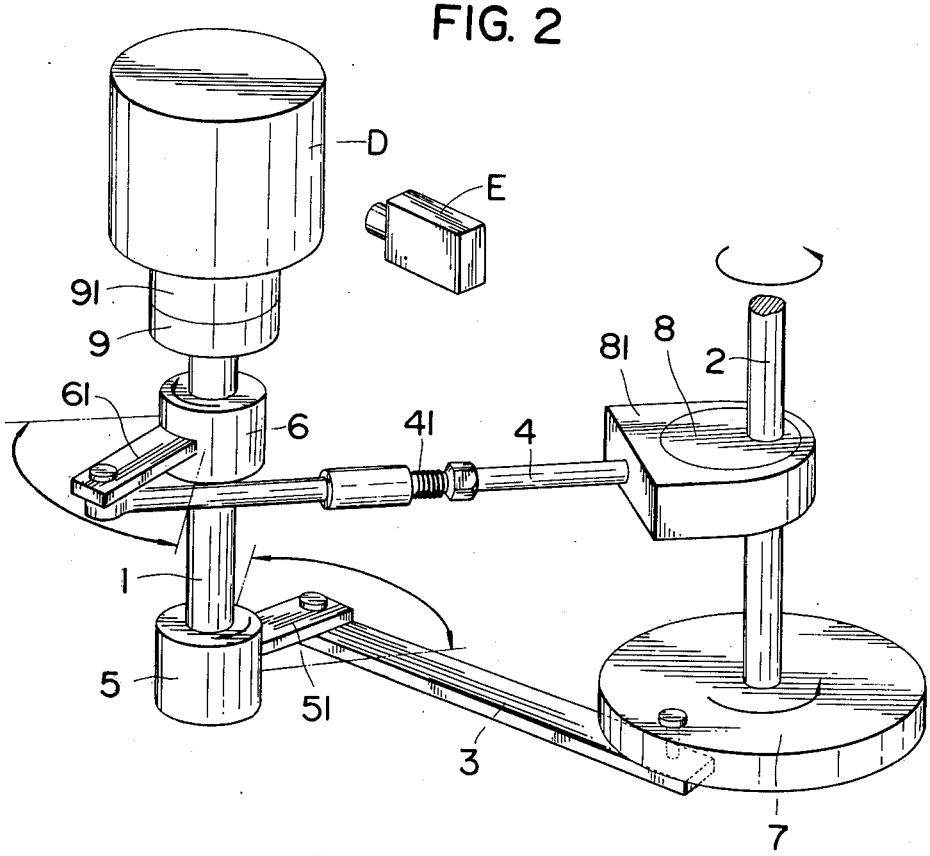
FIG. 2 is an explanatory perspective view showing a mechanism of the tape feeding apparatus.
Figure 3:
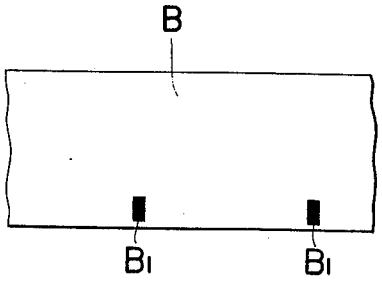
FIG. 3 shows a rear side of a tape of labels.

In the thus constructed arrangement, the present invention is directed more particularly to the tape feeding drum and its driving mechanism for intermittently feeding the tape B to the cutter J as shown in FIG. 2.

A rotary shaft 1 of the drum D is connected by a connecting rod 3 and an auxiliary connecting rod 4 to a drive shaft 2 which is in turn connected to a prime mover such as a motor. The connecting rod 3 is adapted to effect a substantial part of a rotation of the drum D according to the rotation of the drive shaft 2 and the auxiliary connecting rod 4 is adapted to effect the last small part of the rotation of the drum D.

The connecting rods 3 and 4 are not directly connected to the rotary shaft 1 but through levers 51 and 61, respectively. The levers 51 and 61 are connected to clutches 5 and 6, respectively, for conjoint rotation thereof. Said clutches 5 and 6 are mounted on the shaft 1 and provided with, for example, ratchet means to allow the rotary shaft 1 to rotate in one direction only.

A rotary disc 7 and an eccentric rotary disc 8 are connected to the drive shaft 2 so as to rotate conjointly with the drive shaft 2. A follower 81 is rotatably fitted around the eccentric rotary disc 8 and one end of the auxiliary connecting rod 4 is connected to the follower 81. Accordingly, the rotation of the drive shaft 2 is conveyed to the follower 81 in the form of eccentric arcuate movement to rotate the clutch 6 through the reciprocating motion of the connecting rod 4. On the other hand, one end of the connecting rod 3 is pivotally connected to a periphery portion of the rotary disc 7 at 71, so that the rotation of the drive shaft 2 may rotate the clutch 5 therethrough.

In this connection, it is to be noted that this mechanism is so adapted that the rotational speed applied to the clutch 6 may be lower than that speed applied to the clutch 5. Stated illustratively, the distances between the rotary shaft 2 and the respective connecting points of the connecting rods 3 and 4 or the lengths of the levers 51 and 61 are differentiated.

The auxiliary connecting rod 4 is formed of two rod members and provided with a spring member 41 therebetween.

On the rotary shaft 1 there is further mounted an electromagnetic brake 9 and a ratched means 91 for preventing reverse or backward rotation of the rotary shaft 1. The electromagnetic brake 9 is associated with the mark detecting photo-electric tube E and adapted to stop the rotation of the rotary shaft 1 by a signal of detection of the check mark $B_1$ by the photo-electric tube E.

In operation, it will be seen that the rotary disc 7 and the eccentric rotary disc 8 rotate according to the rotation of the drive shaft 2 to reciprocate the main clutch 5 and the auxiliary clutch 6, respectively. The rotary shaft 1 is adapted to rotate only in the pulling stroke of the connecting rod 3 and the pushing stroke of the auxiliary connecting link 4.

In this connection, a phase lag is provided in the movements of the connecting rods 3 and 4 so as to start the pushing stroke of the auxiliary connecting rod 4 just before the connecting rod 3 has entered the pushing stroke from the pulling stroke and to reverse the direction of the stroke of the auxiliary connecting rod 4 into the pulling stroke after the connecting rod 3 has got into the pushing stroke.

The difference in speed applied to the drum D by the two connecting rods 3 and 4 and levers 51 and 61 is digested through the clutches 5 and 6 so that the rotary shaft 1 is rotated by either one of the connecting rods 3 and 4 which is in motion of a higher speed.

These operations will be further explained referring to the movement of the tape B. Most of the feeding of the tape B between the marks $B_1$ is effected by the connecting rod 3 at a high speed and the rest of the feeding of the tape B is effected at a low speed by the auxiliary connecting rod 4 when the photo-electric tube E detects the mark $B_1$. Thus, since the feeding speed of the tape B is already lowered when the photo-electric tube E reads the mark $B_1$, the electromagnetic brake 9 operates effectively to stop the tape precisely at a required position upon reading of the mark $B_1$. Accordingly, even in case the intervals between the marks $B_1$ are not the same and the positions of the marks $B_1$ are somehow lagged with one another, the feeding speed of the drum D is lowered in the vicinity of the mark detection, so that the drum D can be stopped according to the mark $B_1$, instantaneously upon detection of the mark $B_1$.

The electromagnetic brake 9 is adapted to be released after cutting on the tape B by the cutter J, and when the brake 9 is released, the connecting rods 3 and 4 and levers 51 and 61 are in the non-operative positions and undersirable movement of the drum D can be effectively prevented in cooperation with the ratchet means 91 even after release of the brake 9.

Though the brake 9 is adapted to normally operate before the auxiliary connecting rod 4 has reached its dead point, the movement caused by the connecting rod 4 between the stopping of the drum D by the brake 9 and the reaching of the dead point is absorbed by the spring 41 provided between the rod members forming the auxiliary connecting rod 4 so that undesirable force is prevented from being applied to the clutch 6.

Though the position of mark detection by the photo-electric tube E may differ from the position of cutting by the cutter J depending upon the arrangement of the drum D and the cutter J, and the cutter J may cut the tape at a position somewhat preceding the position of the tape B to be subjected to the mark detection by the photo-electric tube E, possible difference in intervals between the respective marks $B_1$ is considered to be negligible within the range of such a distance as caused by the arrangement of the drum D and the cutter J because the expansion and/or contraction of the tape is not caused so locally or at so limited a portion.

Figure 4:
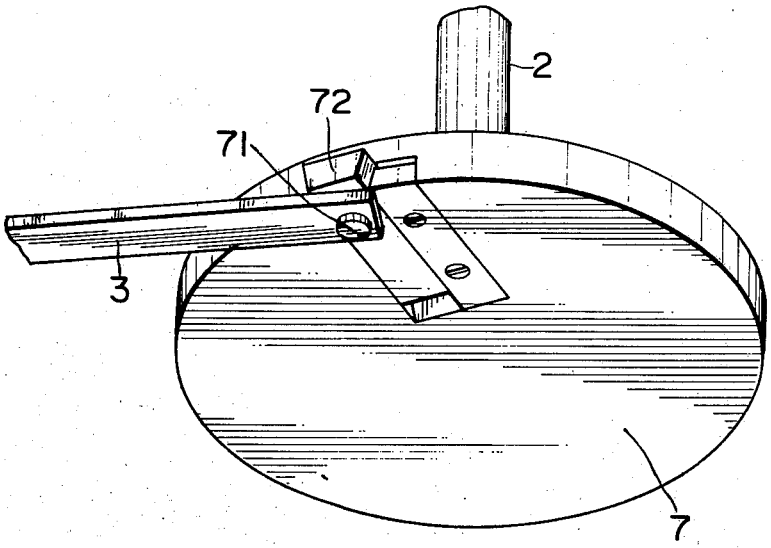
FIG. 4 shows a modification of the present invention.

In FIG. 4, there is illustrated a modification of the foregoing embodiment, which is capable of adjusting the feeding length per one operation to accommodate labels of any length without replacing the components of the mechanism, such as the rotary member 7. For example, the position of the pivotal point 71 of the rotary member 7 and the connecting rod 3 may be changed to achieve this purpose. Stated illustratively, a slide member 72 is depicted in FIG. 4 is mounted on the rotary member 7 so as to be secured in use and slidable in a radial direction for adjustment. To this slide member 72 is pivotally connected the connecting rod 3 and the feeding length of the tape B per one operation can be adjusted according to the length of one label by adjusting the distance between the rotary shaft 2 and the pivotal point 71.

As mentioned above, according to the present invention, when the tape bearing marks whose intervals are not always the same, is required to be fed intermittently according to the marks $B_1$, the greatest part of the feeding is carried out at a high speed and the last part of the feeding just before the stopping is carried out at a low speed so that the feeding of the tape can be stopped instantaneously at a required position. Thus, the present invention is capable of intermittently feeding the tape at a high speed by a desirable length, thus remarkably inproving performance of the labelling apparatus.

In this connection, it is to be noted that the present invention can be applied not only to the labelling apparatus but also to a passimeter or a various ticket machines.

What is claimed is:

1. A tape feeding apparatus comprising a rotary member for feeding a tape; a rotary shaft connected to the rotary member; at least two clutch means connected to the rotary shaft and adapted to rotate said rotary shaft in one direction only; lever members connected to the clutch means, respectively, for effecting rotation of said clutch means; connecting rods pivotally connected to the lever members, respectively; rotary driving means; means drivingly connecting the rotary driving means to said connecting rods for imparting a reciprocating motion to the respective connecting rods according to the operation of the rotary driving means; said lever members and said connecting rods being arranged in positions to rotate the respective clutch means at different speeds and with a phase difference according to the reciprocating motion of the connecting rods so that one of the connecting rods for a low-speed rotation of the rotary shaft is set in operation to drive the shaft just before another said connecting rod enters the nondrive phase of its cycle; and the connecting rod for the low-speed rotation being formed of two rod members and provided with spring means mounted between the two rod members.

2. A tape feeding apparatus, comprising:

rotary shaft means having a rotary tape-feeding member connected thereto for rotation therewith;

first and second one-way clutch means drivingly connected to said rotary shaft means for rotating same in one direction only;

rotary driving means;

first and second linkage means drivingly connected between said rotary driving means and said first and second clutch means, respectively, for rotating said shaft means at different speeds and with a phase difference therebetween, said first linkage means causing a low-speed rotation of said shaft means while said second linkage means causes a higher-speed rotation of said shaft means;

said first linkage means including first lever means connected to said first clutch means for effecting rotation thereof in response to swinging movement of said first lever means, and first connecting rod means pivotally and drivingly connected between said first lever means and said rotary driving means, whereby said rotary driving means causes reciprocation of said first connecting rod means which thereby causes swinging of said first lever means;

said second linkage means including second lever means drivingly connected to said second clutch means for effecting rotation thereof in response to swinging movement of said second lever means, and second connecting rod means pivotally and drivingly connected between said second lever means and said rotary driving means, whereby said rotary driving means imparts a reciprocating motion to said second connecting rod means to thereby swing said second lever means;

said rotary driving means having first and second means associated therewith and drivingly connected to said first and second connecting rod means, respectively, for effecting reciprocating movement thereof with a phase difference therebetween so that said first connecting rod means is drivingly displaced in a direction for causing a low-speed rotation of the rotary shaft means shortly before the termination of the motion of the second connecting rod means in its driving direction;

sensing means coacting with the tape being fed from said rotary member for sensing an indicator or marking on the tape when said shaft means is being driven at said low speed; and brake means for stopping said rotary member when said sensing means senses the indicator or marking on the tape.

3. A tape feeding apparatus according to claim 2, wherein said first connecting rod means is formed by first and second relatively movable rod portions which are connected together by spring means for permitting relative movement between said rod portions, whereby the length of said first connecting rod means is thus subject to change as permitted by said spring means due to continued driving of said first connecting rod means by said rotary driving means after said shaft means has been stopped by said brake means.

4. A tape feeding apparatus according to claim 2, wherein one of said first and second linkage means comprises an eccentric associated with said rotary driving means and connected to one of the connecting rod means, and wherein the other of said first and second linkage means comprises a driving crank connected to said rotary driving means and drivingly interconnected to the other of said connecting rod means, said eccentric and said driving crank being rotated simultaneously and in synchronization with one another at the same rotational speed.

5. A tape feeding apparatus according to claim 2, further including ratchet means connected between said rotary shaft means and said rotary member for allowing rotation of said rotary member in only one direction and for preventing backward rotation thereof.

6. A tape feeding apparatus according to claim 2, wherein one of said linkage means includes adjustment means associated therewith to permit the angle of swinging movement of the respective lever means to be selectively adjusted.

7. A tape feeding apparatus according to claim 6, wherein said adjustment means is associated with said second linkage means.

* * * * *